US009962025B2

(12) United States Patent
Fishbone

(10) Patent No.: US 9,962,025 B2
(45) Date of Patent: May 8, 2018

(54) STACKABLE GLASS

(71) Applicant: Michael Fishbone, Briarcliff Manor, NY (US)

(72) Inventor: Michael Fishbone, Briarcliff Manor, NY (US)

( * ) Notice: Subject to any disclaimer, the term of this patent is extended or adjusted under 35 U.S.C. 154(b) by 0 days. days.

(21) Appl. No.: 15/242,060

(22) Filed: Aug. 19, 2016

(65) Prior Publication Data

US 2016/0353909 A1 Dec. 8, 2016

Related U.S. Application Data

(63) Continuation-in-part of application No. 14/492,434, filed on Sep. 22, 2014, now Pat. No. 9,420,906.

(60) Provisional application No. 61/984,958, filed on Apr. 28, 2014.

(51) Int. Cl.
*A47G 19/23* (2006.01)
*A47G 19/22* (2006.01)

(52) U.S. Cl.
CPC ..... *A47G 19/23* (2013.01); *A47G 19/2205* (2013.01); *A47G 19/2255* (2013.01)

(58) Field of Classification Search
CPC ..... A47G 19/23; A47G 19/2255; B65D 21/0209; B65D 21/02; B65D 21/0233
USPC ..... 220/703, 635, 629
See application file for complete search history.

(56) References Cited

U.S. PATENT DOCUMENTS 3,526,335 A * 9/1970 Swett ..... A47G 19/2255 215/10
3,932,113 A * 1/1976 Thrush ..... F21V 35/00 215/10
6,149,119 A * 11/2000 O'Connell ..... A47G 7/025 248/146
7,861,888 B2 * 1/2011 Niedzwiecki ..... A47G 19/2255 206/499

* cited by examiner

*Primary Examiner* — Stephen Castellano
(74) *Attorney, Agent, or Firm* — Cozen O'Connor

(57) ABSTRACT

A stackable glass having a bowl with a rim and a partially hollow base formed by a wall coupled to the bowl opposite the rim. A central structure is arranged in the partially hollow base that extends away from the bowl. The central structure and tapers toward the wall of the partially hollow base to define an annular moat surrounding the central structure. There is at least one vent passing through the wall of the partially hollow base arranged in the partially hollow base proximate to a point at which the central structure meets the wall of the partially hollow base that provides a passage between an inside of the partially hollow base and an outer surface of the stackable glass.

13 Claims, 9 Drawing Sheets

STACKABLE GLASS

RELATED APPLICATION

This application is a continuation-in-part of U.S. application Ser. No. 14/492,434 which was filed on Sep. 22, 2014, now U.S. Pat. No. 9,420,906, and claims priority to U.S. Provisional Application Ser. No. 61/984,958 filed on Apr. 28, 2014 all of which are hereby incorporated by reference.

BACKGROUND OF THE INVENTION

1. Field of the Invention

The present invention relates to a stackable glass set. In particular the present invention relates to a stackable glass set that provides for a reduction in vacuum pressure and for the release of liquid if the stacked glasses are wet in order to avoid glass breakage, scaring, and/or mold formation

2. Description of the Related Art

Liquor glasses are typically stacked after being washed in restaurants and bars. One of the problems associated with stacking wet liquor glasses is that it can often lead to glass breakage due to the vacuum pressure formed by hot water vapor condensation within the stacked arrangement of glasses. It would be preferable to be able to design a liquor glass set that can be stacked in an aesthetically pleasing arrangement conducive to an attractive decor for a bar or a restaurant setting and which provide for fluid drainage and air circulation within each of the stacked glasses so as to avoid glass breakage, mold formation and excessive mineral deposits. It would be preferable to design a chalice that mimics the elegance of a classic snifter shape, while suiting the needs of a limited-space bar or restaurant, which might otherwise be unable to offer their guests proper stemware.

U.S. Pat. No. 2,239,153 to William relates to stacked cups that permit cleaning fluid to exit the interior of the cups through flutes and leave in the same manner.

U.S. Patent Publication 2008/290102 to Mongano discloses a wine glass with holes at the base of the bowl's interior for enhanced aeration of the wine during swirling.

It would be desirable to provide for a set of stackable liquor glasses that is structured to eliminate vacuum pressure in stacked arrangement and provide for liquid release to allow wet, hot glasses to be stacked without the risk breakage due to vacuum formation. It would also be desirable to design a set of liquor glasses that can be stacked in an aesthetically pleasing arrangement conducive to an attractive decor for a bar or a restaurant setting.

It would be desirable to provide a stackable set of glasses that can be stacked hot and wet in a stable structure, where the interior of the bowl of the top glass is not wedged against the exterior of the bottom glass, as is found in other stacked arrangements. Such stacked arrangements leave the glasses highly susceptible to surface scaring and cracking. Additionally, glasses that are stacked by means of wedging have yet to produce a shape attractive to connoisseurs of fine beverages.

SUMMARY OF THE INVENTION

The present invention provides for a set of stackable liquor glasses in which each glass has in its stem, a set of equidistantly spaced holes (preferably four) to reduce vacuum pressure. In addition, the present invention provides a structure with a drainage passage, connected to the enclosure within the stem, vented by the four holes, for passage of fluid and air. The drain passage drains fluid through an asymmetric pathway for drainage outside of the glass. In addition, a flat surface surrounding the lowest point of the glass' interior provides for a receptacle for the stacked glass to rest upon.

DETAILED DESCRIPTION OF THE PRESENTLY PREFERRED EMBODIMENTS

Figure 1:
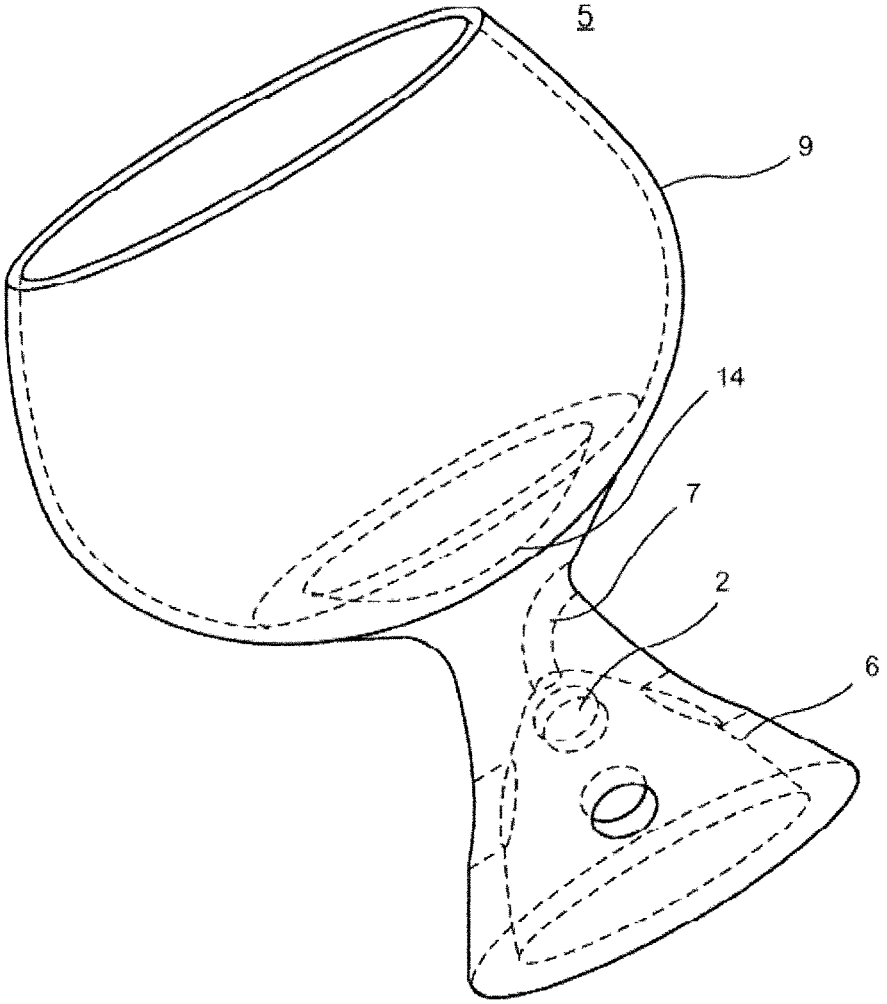
FIG. 1 is a perspective view of the present invention.
Figure 2:
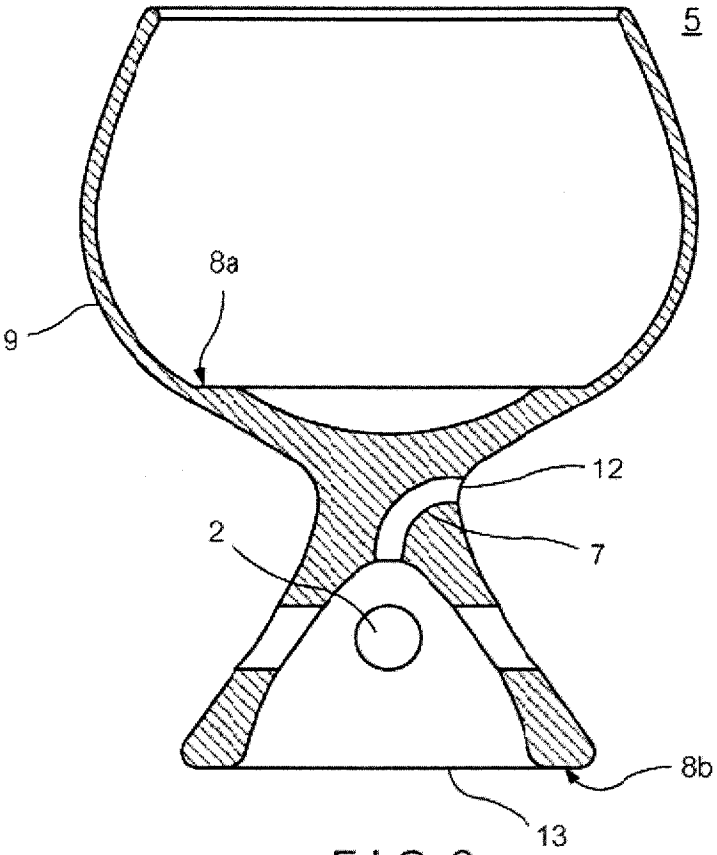
FIG. 2 is a sectional view of the present invention.

Referring to FIGS. 1-4 of the drawings, FIG. 1 is a perspective view of a stackable liquor glass 1 in accordance with the present invention. The stackable glass 1 includes a stem 3 and a bowl 5. The bowl 5 is sealed off from the stem 3 of the glass 1 at a bottom surface 14 of the bowl 5 so that fluid in the bowl 5 does not pass into the stem 3. The stem 3 has an opening 13 at the bottom of the stem wherein residual washing/rinsing liquid collects when the glass 5 is stacked in an upside down arrangement as shown in FIG. 3A. The stem 3 is formed as an enclosure within the bottom portion of the glass 1 with holes 2 placed equidistantly about the stem enclosure 6, each separated by 90 degrees of rotation. There are preferably four (4) holes 2 about the stem enclosure 6 of the glass 1 (see FIG. 2). The holes 2 eliminate vacuum formation caused by the stacking of the glasses 1 when the hot, wet glasses 1 cool to ambient temperature. The glass 1 of the present invention also includes a drain 7 between the stem 3 of the glass 1 and the bowl 5 (see FIG. 2). The drainage pathway links the enclosure 6 and an exit formed as a hole or opening 12 for liquid just beneath the bowl 5 when the glass 1 is in an upright position (conversely, located above the bowl in a stacked, upside-down arrangement (see FIGS. 2, 3 and 4). The drain 7 provides an asymmetric pathway or passage for residual rinsing water to exit the enclosure 6 through the opening 12 when the glass 1 is in its upside down stacked arranged position. The drain 7 is of ample diameter to avoid capillary action of residual rinsing water for borosilicate, commercial, and lead glass. FIG. 2 shows an individual glass 1 from a perspective view showing the drain 7 and one of the holes 2. As can be seen, the stem 3 is contained in the bottom portion of the glass 1 and has a set of holes 2 through which air can egress from the enclosure 6 through the holes 2 to outside of the glass 1.

Figure 3:
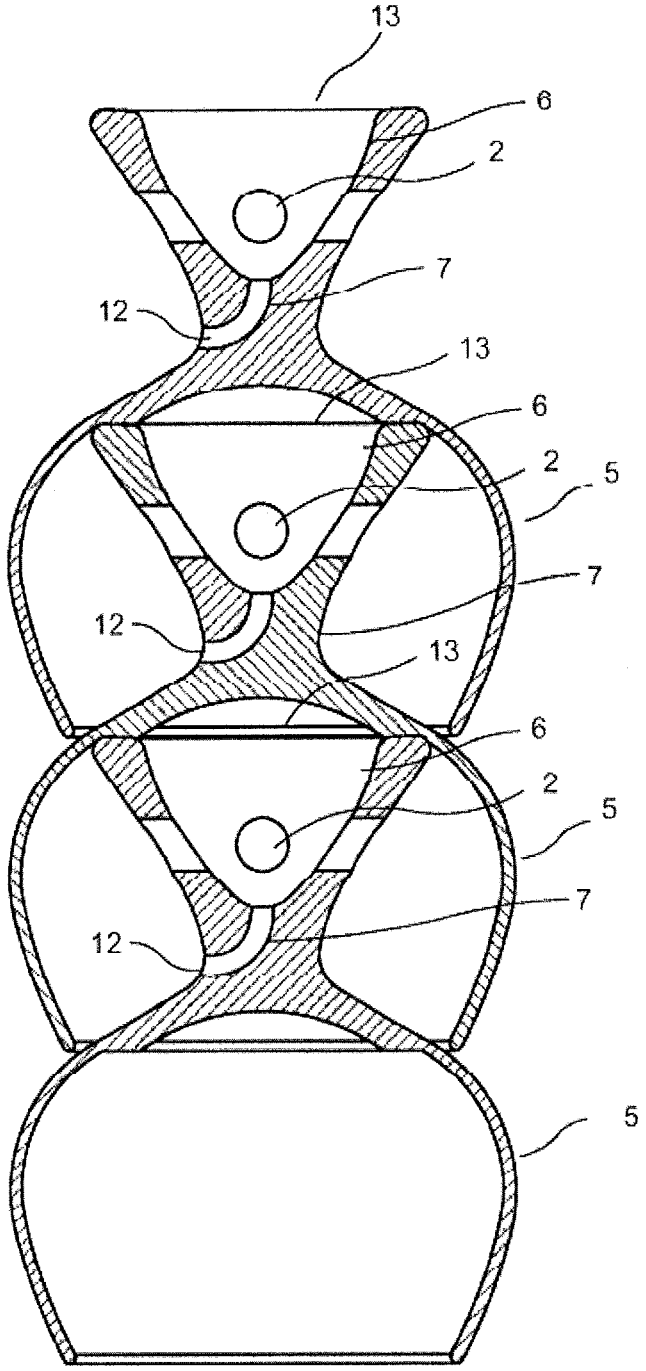
FIG. 3 shows the liquor glasses of the present invention in an upside-down stacked arrangement in sectional view.

In addition the glass 1 of the present invention includes a flat surface 8*a* on which another of the stacked glasses 1 can rest its resting base 8*b* in stacked position on as can be seen in FIG. 3. The flat surface 8 acts as a shelf for the stacked glass 1 to rest upon.

FIG. 3 shows the glasses 5 of the present invention in a stacked arrangement where each glass rests in an upside down position on flat surface 8 of the glass of which it is housed inside. The flat surface 8 can be manufactured in one piece with the glass 1 or adhesively connected or otherwise bonded to the inside of the glass 1 as shown in FIG. 3.

Figure 4:
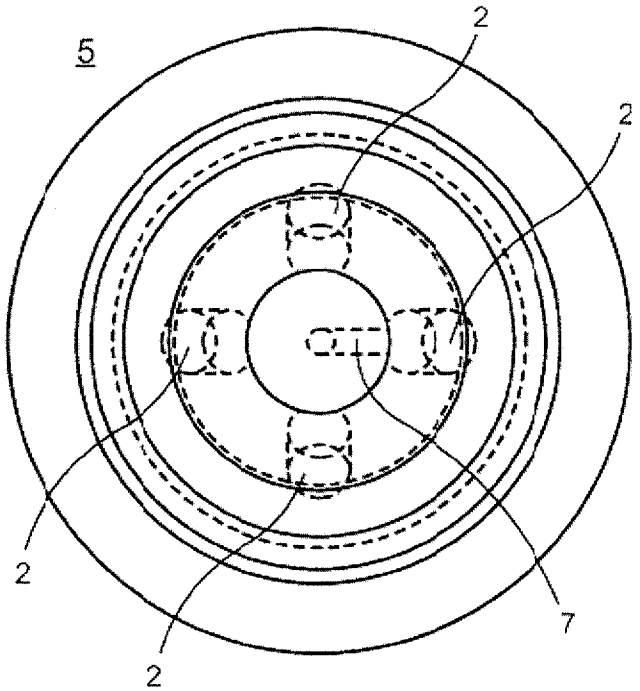
FIG. 4 shows a top view of FIG. 2 of the present invention.

FIG. 4 shows an individual one of the glasses 1 from a top view showing the drain 7 and the holes 2.

Figure 5:
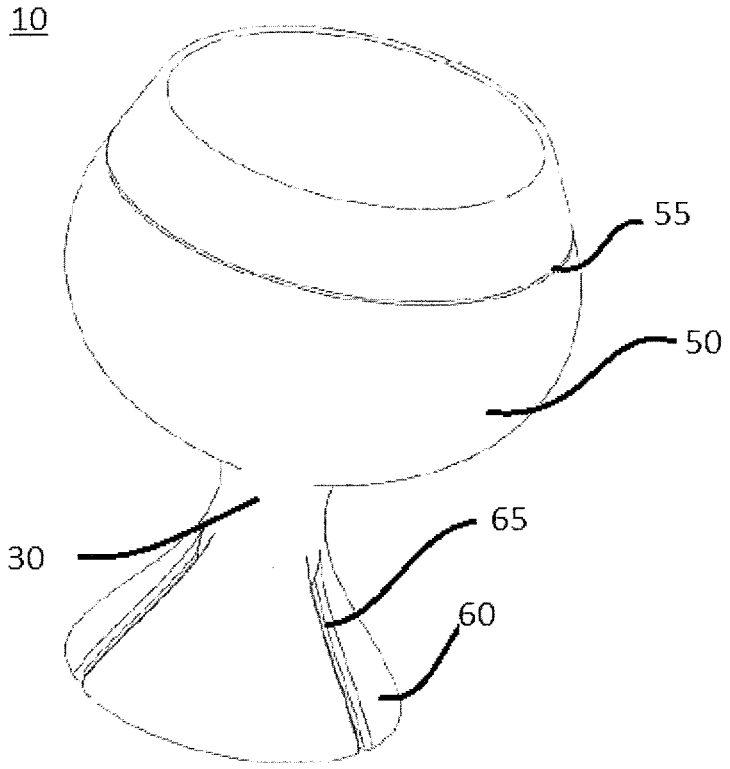
FIG. 5 is a perspective view of the present invention.
Figure 6:
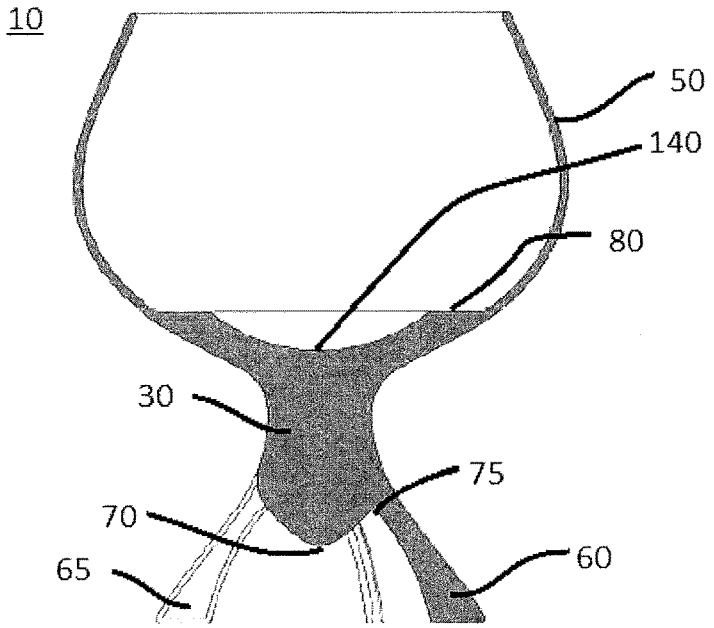
FIG. 6 is a sectional view of the present invention.

FIG. 5 is a perspective view of a stackable glass 10 in accordance with an aspect of the present invention. The stackable glass 10 includes a stem 30, a base 60, and a bowl 50. As shown in FIG. 6, the bowl 50 is sealed off from the stem 30 of the glass 10 at a bottom surface 140 of the bowl 50 so that fluid in the bowl 50 does not pass into the stem 30. In one embodiment, the stem is part of the base. In one embodiment, the bowl 50 has a fill line 55. The fill line 55 can be etched, printed, molded as a score, or the like. The glass 10 is preferably glass. However, any suitable material such as a polymer or plastic can be used to make the glass. The glass can be mold blown, injection molded, press molded, blown, a press and blow method, or the like.

Figure 9:
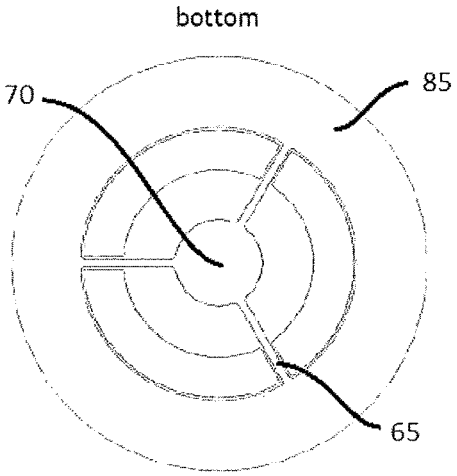
FIG. 9 is a top view of the glass.
Figure 11:
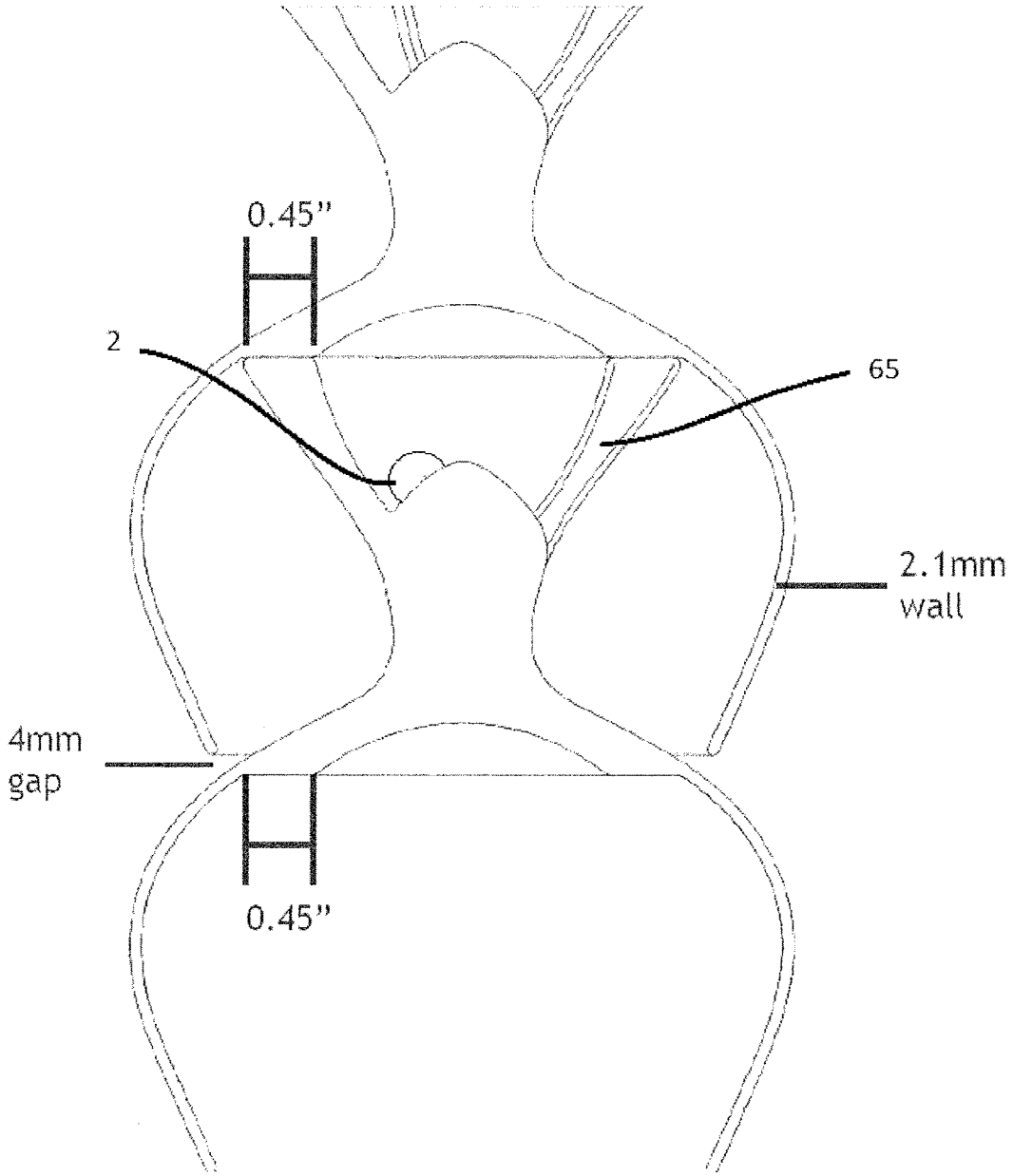
FIG. 11 is the glasses in a dimensioned upside-down stacked arrangement in sectional view.

The base 60 has at least one opening 65. In one embodiment, the opening is configured as a slot running from a distal end of the base 60 to the stem. While shown as a slot, the opening can also be configured as a hole 2 as shown in FIG. 11. Alternatively, other shapes including ovals, squares, stars, rectangles, and the like can be used. Preferably, there are three slots equidistantly spaced about the base, as shown in FIG. 9, but there can be more than three slots or openings.

Figure 12:
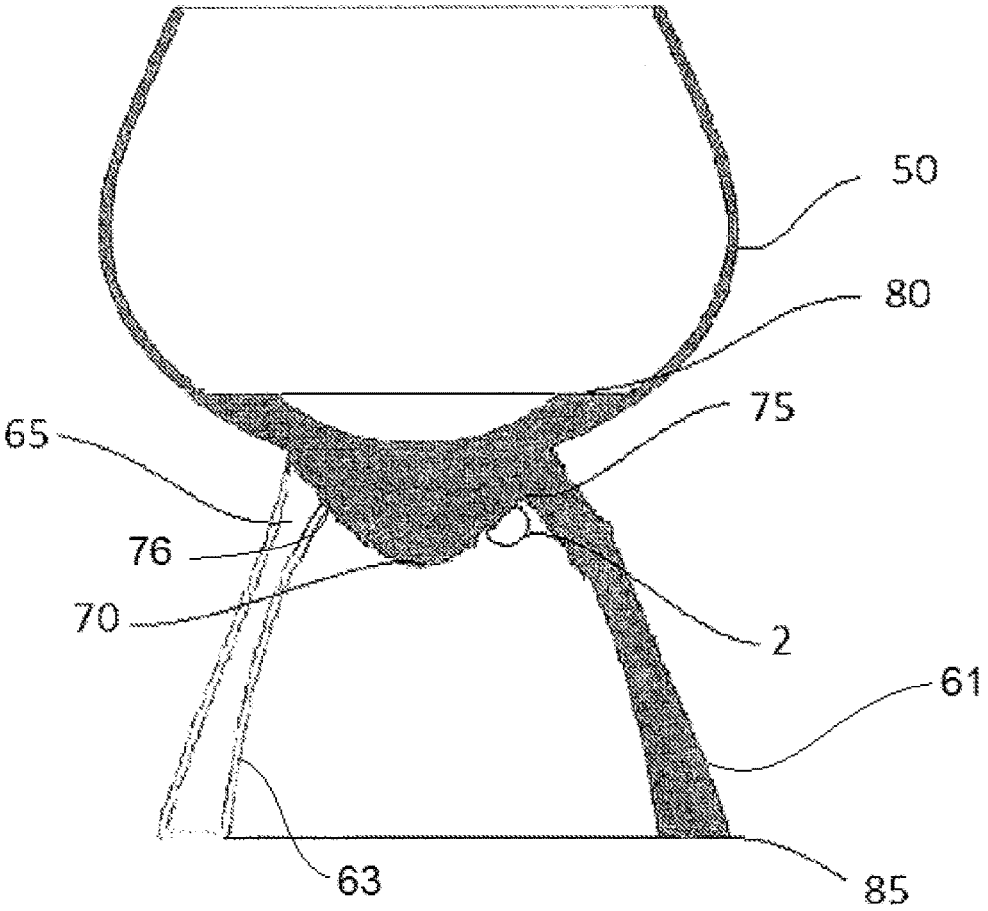
FIG. 12 is a sectional view of the present invention.

The base 60 defines a hollow space. Arranged in the base 60 is a raised portion 70, also referred to as a central upstanding punt or punt. The raised portion 70 tapers towards the wall of the base 60 forming a moat 75. The one or more slots or openings meets the bottom of the moat as shown in the cross-sectional view in FIG. 6. In this manner, any liquid in the moat will drain from the moat 75 via the openings 65. The base 60 of the stackable glass 10 includes the annular moat 75 defined between the wall of the base and a central upstanding punt 70. In this embodiment, the punt 70 defines an upstanding structure extending angularly away from the bowl 50 and inwardly at an angle toward base 85. As shown in FIG. 12, the base 60 comprises an outer wall 61 and an inner wall 63. The vents are arranged proximate to inflection point 76, which is where the inner wall 63 meets the rise of the punt 70.

In one embodiment, the bottom of the moat, which is the point at which the base 60 meets the tapered edge of the raised portion 70 is substantially planar. In one embodiment, the bottom of the moat, which is the point at which the base 60 meets the tapered edge of the raised portion 70 is not planar such that the one or more openings are arranged at low points of the moat for drainage purposes. The moat 75 is tapered to direct fluid to the one or more openings 65.

Figure 7:
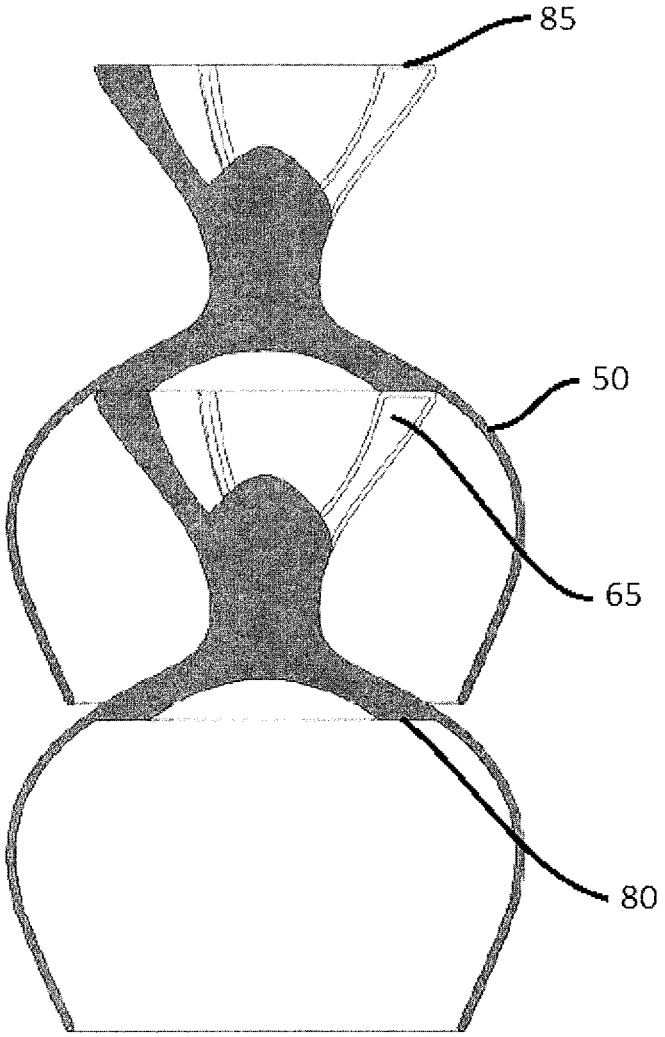
FIG. 7 is the glasses in an upside-down stacked arrangement in sectional view.

Residual washing/rinsing liquid collects in the moat 75 when the glass 10 is stacked in an upside down arrangement as shown in FIG. 7. The one or more slots 65 eliminate vacuum formation caused by the stacking of the glasses 10 when the hot, wet glasses 10 cool to ambient temperature. The one or more slots also functions as a drain so that the washing/rinsing liquid that collects in the moat 75 can drain.

Figure 8:
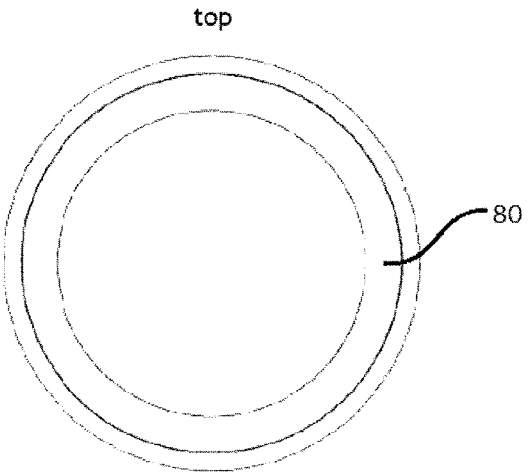
FIG. 8 is a top view of the glass.

The glass 10 of the present invention includes a flat surface 80 on which another of the stacked glasses 10 can rest its resting base 85 on, in stacked position, can be seen in FIG. 7. The flat surface 80 acts as a shelf for the stacked glass 10 to rest upon. The resting base 85 can be seen in FIG. 8. It should be noted that the slot 65 can traverse the entire base 60 or only a portion of the base 60. As shown in FIG. 9, the slot 65 does not form a break in the resting base 85, which is the glass base. The slot 65 must meet the moat 75 to provide a drain from the moat 75.

FIG. 7 shows two glasses 10 in a stacked arrangement where each glass 10 rests in an upside down position on flat surface 80 of the glass of which it is housed inside. The flat surface 80 can be manufactured in one piece with the glass 10 or adhesively connected or otherwise bonded to the inside of the glass 10.

Figure 10:
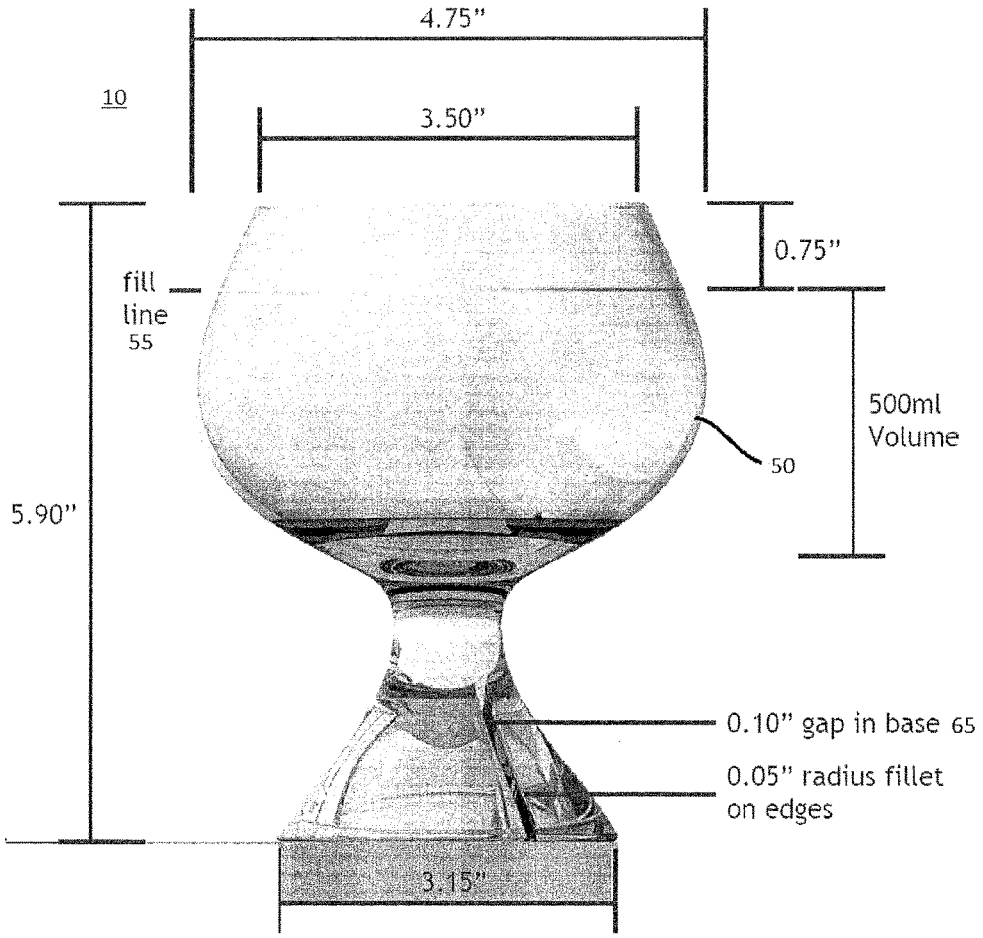
FIG. 10 is a dimensioned side view of the glass.

FIG. 10 is a 500 ml glass according to one embodiment of the invention. Other dimensions are conceivable. The present embodiment is provided as one specific example of a glass in accordance with the present invention. The glass has an overall height of about 5.9 inches. As shown, the mouth of the glass is about 3.5 inches. The widest part of the bowl 50 is about 4.75 inches. The opening 65, configured as a slot is about 0.1 inches wide, and preferably has a 0.05 inch radius fillet. As shown in FIG. 11, the width of the resting base 85, which is the base of the glass 10, is about 0.45 inches. The corresponding flat surface 80 is also about 0.45 inches. Preferably, when the glasses are stacked, there is a 4 mm gap between the mouth of a first glass and the bowl of a second glass.

FIG. 12 is similar to FIG. 6 except the stem 30 is shortened or not present. The wall of the base is supports the bowl directly. As shown, the glass can have a slot 65 or a hole 2 arranged at the moat 75. The Hole 2 is arranged at the point at which the punt 70 meets the wall of the base. Likewise, the slot 65 preferably begins at the point at which the punt 70 meets the wall of the base. The resting base 85 is configured to rest on the flat surface 80 when the glasses are stacked.

It should be noted that while the glasses can be stacked right-side up or upside down, it is preferred that the glasses are stacked upside down so that residual washing/rinsing liquid that collects in the moat 75 drains vial hole 2 or slot 65.

While presently preferred embodiments have been described for purposes of the disclosure, numerous changes to the arrangement of the apparatus' parts can be made by those skilled in the art. Such changes are encompassed within the spirit of the invention as defined by the appended claims.

The invention claimed is:

1. A stackable glass, comprising:

a bowl having a rim;

a partially hollow base formed by a wall coupled to the bowl at a first end opposite the rim and configured to support the bowl, the wall comprising an inner wall and an outer wall, a structure having a central punt arranged in the partially hollow base that extends away from the bowl tapering radially inwardly from the wall forming the partially hollow base-and an annular space surrounding the central punt, the space arranged at a base of the punt between the central punt and the wall forming the partially hollow base; and at least one vent passing through the wall of the partially hollow base and arranged in the partially hollow base proximate to an inflection point at which the central punt meets the inner wall of the partially hollow base and configured to provide a passage between an inside of the partially hollow base and an outer surface of the stackable glass for liquids when the glass is inverted.

2. The stackable glass of claim 1, wherein the at least one vent is configured as a slot in a wall.

3. The stackable glass of claim 1, wherein there are at least three equidistantly spaced slots.

4. The stackable glass of claim 2, wherein the at least one vent configured as the slot extends towards a second end of the partially hollow base opposite the first end.

5. The stackable glass of claim 4, wherein the at least one vent configured as the slot extends through the second end of the partially hollow base.

6. The stackable glass of claim 1, wherein the stackable glass is constructed from one of plastic and glass.

7. The stackable glass of claim 1, further comprising a ledge arranged in the bowl at a distance from the rim of the stackable glass, the ledge configured to mate with a second end of the partially hollow base.

8. The stackable glass of claim 7, wherein a diameter of the rim is greater than a diameter of the bowl at a point on the bowl that is equal to the distance from the rim of the stackable glass to the ledge measured from the second end of the partially hollow base towards the rim.

9. The stackable glass of claim 1, wherein a plurality of vents are arranged in the wall of the partially hollow base.

10. The stackable glass of claim 9, wherein the plurality of vents are equidistantly spaced.

11. The stackable glass of claim 10, wherein the plurality of vents are substantially arcuate.

12. The stackable glass of claim 1, wherein the partially hollow base formed by a wall is coupled to the bowl by a stem.

13. The stackable glass of claim 1, wherein a bottom of the space is not planar.

* * * * *